US006589341B1

(12) United States Patent
Michael

(10) Patent No.: US 6,589,341 B1
(45) Date of Patent: Jul. 8, 2003

(54) POWDER COATING DEVICE

(75) Inventor: Hans Peter Michael, St. Gallen (CH)

(73) Assignee: ITW Gema AG, St. Gallen (CH)

( * ) Notice: Subject to any disclaimer, the term of this patent is extended or adjusted under 35 U.S.C. 154(b) by 0 days.

(21) Appl. No.: 09/701,439

(22) PCT Filed: Dec. 15, 1999

(86) PCT No.: PCT/EP99/09939

§ 371 (c)(1),
(2), (4) Date: Feb. 5, 2001

(87) PCT Pub. No.: WO00/53334

PCT Pub. Date: Sep. 14, 2000

(30) Foreign Application Priority Data

Mar. 11, 1999 (DE) ..... 199 10 748

(51) Int. Cl.[7] ..... B05C 19/00

(52) U.S. Cl. ..... 118/308; 118/684; 403/50; 464/79

(58) Field of Search ..... 118/303, 684, 118/308; 403/50, 109.1, 111; 277/391, 392; 464/79

(56) References Cited

U.S. PATENT DOCUMENTS

| | | | | | |
|---|---|---|---|---|---|
| 1,752,106 | A | * | 3/1930 | Persons | 464/79 |
| 3,612,549 | A | * | 10/1971 | Berkowitz | 277/410 |
| 3,625,404 | A | | 12/1971 | Probst | |
| 4,335,587 | A | * | 6/1982 | Thomamueller et al. | 464/106 |
| 4,645,473 | A | * | 2/1987 | Mochizuki | 467/79 |
| 4,941,778 | A | | 7/1990 | Lehmann | |
| 5,233,247 | A | * | 8/1993 | Stark | 464/79 |

FOREIGN PATENT DOCUMENTS

| | | |
|---|---|---|
| DE | 44 09 493 A | 9/1994 |
| EP | 0 297 309 | 3/1988 |
| EP | 0 864 849 A | 9/1998 |

* cited by examiner

*Primary Examiner*—Richard Crispino
*Assistant Examiner*—Yewebdar T Tadesse
(74) *Attorney, Agent, or Firm*—Lowe Hauptman Gilman & Berner, LLP

(57) ABSTRACT

A powder coating system comprising at least one throttle unit (10) which is adjusted by an electric motor, preferably a stepping motor (6) through a bellows connector (12).

11 Claims, 2 Drawing Sheets

POWDER COATING DEVICE

TECHNICAL FIELD

The invention relates to a powder coating system. More particularly, the invention relates to a powder coating system containing at least one adjustable throttle unit throttling the flow in at least one compressed air duct connected to a powder flow path along which the powder is pneumatically conveyed, and wherein, for each throttle unit, the system contains one electric motor connected to drive a rotating adjustment shaft of the throttle.

A powder coating system of this kind is already known from the German patent document 44 09 493A1 and in a similar way from the U.S. Pat. No. 3,625,404. Its throttle unit contains two throttles selectively adjusted manually or by an adjusting motor. Each of the throttles consists of a valve seat and a valve body mounted opposite each other. The two valve bodies are connected to each other. In this manner one throttle is being opened to the extent the other one is being closed when a shaft connected to them is axially adjusted, either manually or by the adjusting motor, by being rotated inside a thread.

The European patent document 0 297 309 B1 discloses a powder coating system wherein a flow throttle adjusted by its own control drive is mounted in a conveying air duct and in a supplementary air duct. Both ducts are connected on one hand to a source of compressed air and on the other hand to an injector implementing pneumatic powder conveyance. The conveying air generates a partial vacuum in the injector and in this manner aspirates powder out of a powder container. If more powder per unit time must be conveyed, a larger partial vacuum or suction is required and is produced by a commensurately adjusted larger flow of conveyance air. In order to assure that an approximately constant rate of air shall flow inside the powder duct pneumatically conveying the powder when the rate of conveyance air is raised or lowered, the additional air must be decreased when raising the conveyance air, and vice versa. Excessive air in the powder duct leads to blowing powder off the object being coated. Insufficient air entails powder pulses and powder deposits in the powder duct. An electronic control regulates the adjustment of the two throttles as a function of the quantity of powder per unit time being conveyed. The two throttles are not interconnected mechanically, but one linked only by the electronic control.

SUMMARY OF THE INVENTION

The adjustment shaft of the adjusted flow throttle is rotatable and implements axial adjustment displacements. Therefore, when using an electric motor to rotate the adjustment shaft, an axially variable connection is required between the adjustment shaft and a motor shaft in the event the motor shaft cannot be shifted adequately in the axial direction. Any desired throttle unit requires a corresponding rotation or a change in angle of rotation of the motor shaft. On account of the electric motors starts and stops, such throttle units will generate clickety-clack noises. Any electric motor is suitable as the adjustment drive of the flow throttle provided said motor shall offer accurate angular speeds and angular positioning as function of the drive applied by an electronic control unit.

The objective of the invention is to use an electric motor to implement in simple and economical manner accurate, low-noise and reproducible adjustment motions of the adjustment shaft.

Accordingly, the above problem is solved by the electric motor driving through a bellows connector the adjustment shaft of the throttle unit and in that a drive shaft of the stepping motor, the bellows and the adjustment shaft of the throttle unit are configured in axial manner.

Any type of electric motor will be appropriate which when electrically driven is able to carry out defined rotations, for instance DC motors, in particular however stepping motors and motor/gearing units wherein the gear reduces the angular motor speed are well suited.

The invention offers the following advantages, namely low noise and accurate and reproducible adjustment of the throttle unit. A stepping motor can be rotated in simple manner by electric pulses into an angular displacement corresponding to one step. Each step corresponds to a given throttle position. Because the number of steps required for any throttle adjustment can be predetermined, each throttle adjustment can be accurately reset any time. When using separate throttles for separate compressed air ducts, the air flow in each compressed air duct can be set individually and accurately. Preferably an electronic control unit is used for that purpose which can be preprogrammed with reference values for the rate of powder conveyed and/or the commensurate required air flows. The adjustable element of the throttle is mechanically connected to an adjustment shaft axially displaceable inside a thread in order to move the adjustable element back and forth. The adjustable element of the throttle, which ordinarily is not a valve seat but instead a valve cone, is correspondingly moved back and forth through the throttle's thread. This axial displacement must be compensated relative to the axially stationary drive shaft of the stepping motor. This axial compensation is implemented in the invention by the simple design of a bellows connector. Moreover this bellows connector also effectively damps the noise generated by the stepping motor rotating in abrupt small steps. In the absence of the bellows connector, said steps of the said stepping motor would entail a more than trivial noise pollution. Said bellows automatically compensates any small, angular, axial and/or radial shift between the stepping-motor's drive shaft and the adjustment shaft of the throttle as caused by manufacturing tolerances or in assembly. The system as a whole can be manufactured using simple, commercial elements and therefore it is also economical. The bellows of the bellows connector exhibits the property of being torsionally inelastic but damping and being comparatively compliant to axial loads. The bellows of the bellows connector may be made of any flexible material, preferably an elastically compressible material, also preferably of rubber.

BRIEF DESCRIPTION OF THE DRAWINGS

The invention is elucidated below by illustrative embodiments and in relation to the attached drawings.

DETAILED DESCRIPTION OF THE INVENTION

Figure 1:
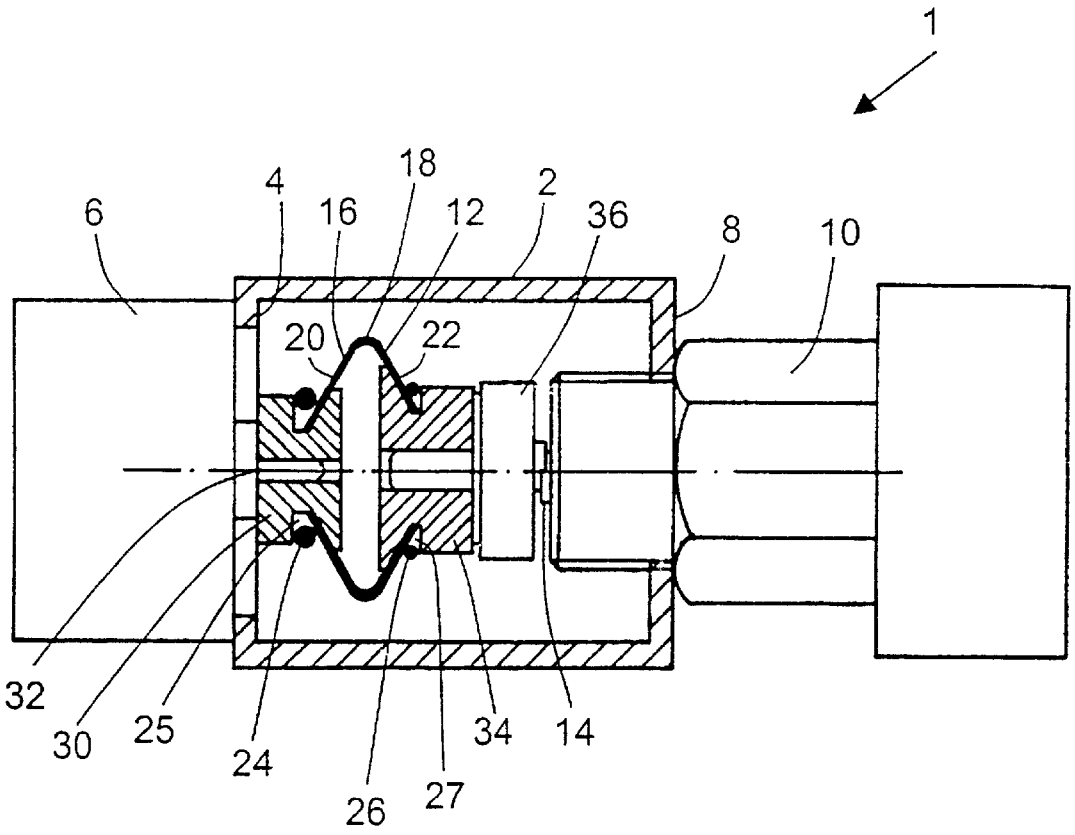
FIG. 1 schematically shows a sub-assembly of a throttle unit and an electric motor connected to through a driving single-pleat bellows connector, FIG. 2 schematically shows a powder coating system of the invention, and FIG. 3 schematically shows another embodiment of a sub-assembly consisting of a throttle unit and of an electric stepping motor connected by a single-pleat bellows connector to the adjustment element of said throttle unit.

The sub-assembly 1 of the invention shown in FIG. 1 in longitudinal section consists of a housing 2, an electric motor, preferably a stepping motor 6 affixed to a housing end-face 4 of the housing, a throttle unit 10 affixed to an oppositely situated housing end face 8, and a bellows connector 12 axially mounted inside the housing 2 relative to the stepping motor 6 and the throttle unit 10.

The throttle unit 10 contains at least one throttle fitted with a stationary—or axially displaceable—throttling valve seat and a throttle valve body configured axially (or in stationary manner) thereto. For the purpose of axial displacement, the throttling valve body is irrotationally connected to the adjustment shaft 14.

The bellows connector 12 comprises a bellows 16 optionally of several pleats but preferably only one pleat with a bend 18 at its outer periphery. The two inner ends 20 and 22 of the bellows 16 situated on a substantially smaller diameter are each clamped radially and axially by an annular element, preferably made of rubber, which is diametrically and radially resilient, preferably an O-ring 24 and 26 into an external circumferential slot 25 and 27 resp. One external circumferential slot, namely 25, is present in a hookup ring 30 mounted in irrotational manner on a drive shaft 32 of the stepping motor 6. The other external circumferential slot 27 is present in a hookup ring 34 irrotationally mounted on an adapter shaft 36 itself irrotationally connected to the adjustment shaft 14 of the throttle unit 10. The bellows 16 per se is displaceable angularly, axially and radially in order to compensate against angular, axial and/or radial deviations and changes between the drive shaft 32 and the adjustment shaft 14. Consequently the bellows radially inward segments 20 and 22 are mutually displaceable in angular, axial and radial manner. The bellows 16 is comparatively stiff when torsion-loaded, however it dampens impacts. In other words, the bellows ends 20 and 22 are only restrictedly mutually rotatable and in the event of such torsional displacements, and on account of its material properties, the bellows will act as a shock-absorber. Preferably the bellows 16 is made of rubber or a material which is inherently similarly resilient.

The application of the sub-assembly 1 of FIG. 1 is described below in relation to FIG. 2. The power coating system of FIG. 2 contains three sub-assemblies 1.

Figure 2:
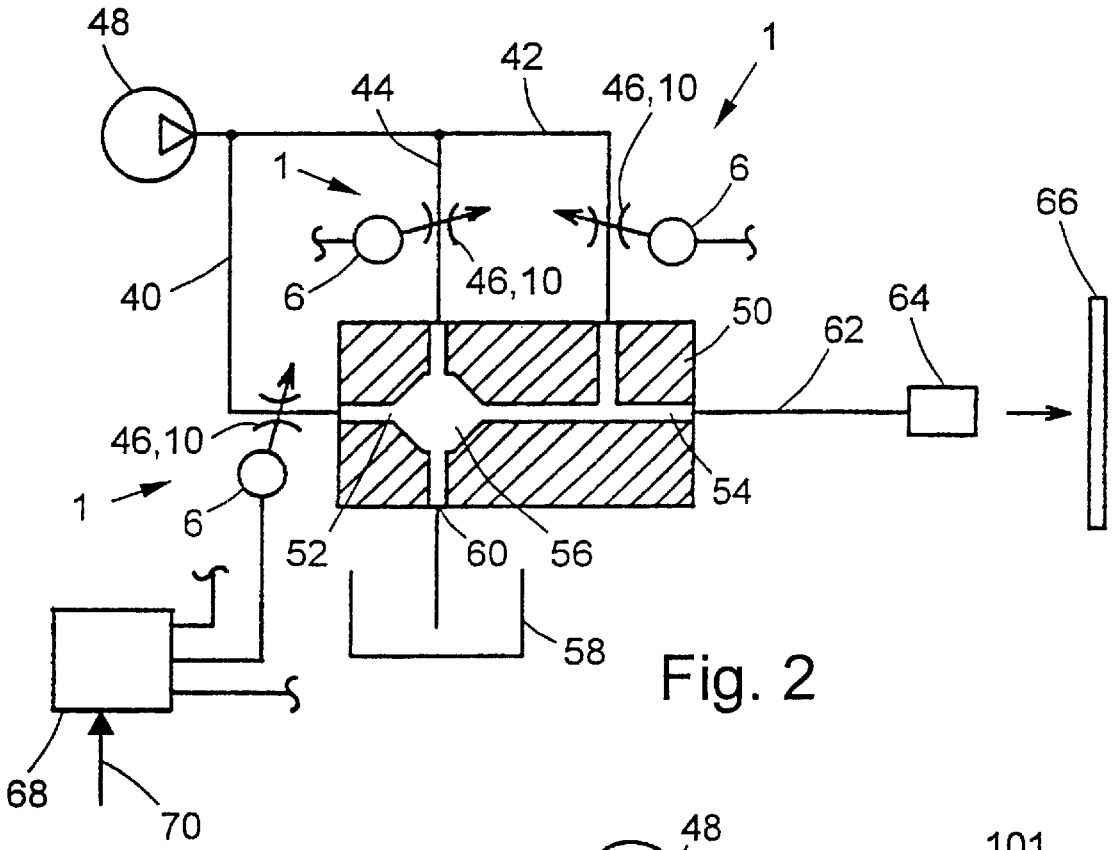

The powder coating system of FIG. 2 contains a conveyance-air duct 40, a first supplemental-air duct 42 and a second supplemental-air duct 44 each fitted with an adjustable throttle 46 of the throttle unit 10 of another sub-assembly 1 and each connected on one hand to a source of compressed air 48 and on the other hand to an injector 50. The injector 50 operates as a pneumatic pump operating on the venturi principle.

Air from the conveyance-air duct 40 axially flows inside the injector 50 from an injector nozzle 52 into an axially opposite powder discharge duct 54 and produces a partial vacuum or suction in an intermediate suction zone 56. Said partial vacuum or suction evacuates coating powder from a power container 58 through a powder intake 60 into flow of conveyance air. The mixture of conveyance air and powder flows through a powder hose 62 to a sprayer 64 which sprays it on an object 66 to be coated. The first supplemental-air duct 42 is connected to the powder discharge duct 54 sufficiently downstream of the suction zone 56 that it shall no longer affect said suction or at most only trivially. This first supplemental air keeps the total air flow constant by compensating changes in the flow of conveyance air, when this air flow of the conveyance-air duct 40 is increased or decreased, to increase or decrease the rate of powder.

The second supplemental-air duct 44 is used only rarely and for the purpose of controlling the magnitude of the partial vacuum in the partial-vacuum zone 56, in addition to or independently of the air of the conveyance-air duct 40 and hence also to control the rate of conveyed powder.

As a function of at least one reference value 70 of the rate of conveyed powder and/or the air flow in the conveyance air duct 40, of the first supplemental air duct 42 and/or of the second supplemental air duct 44, an electronic control unit 68 regulates the setting of its associated throttle 46 by means of the electric stepping motor 6 of the sub-assembly 1.

Figure 3:
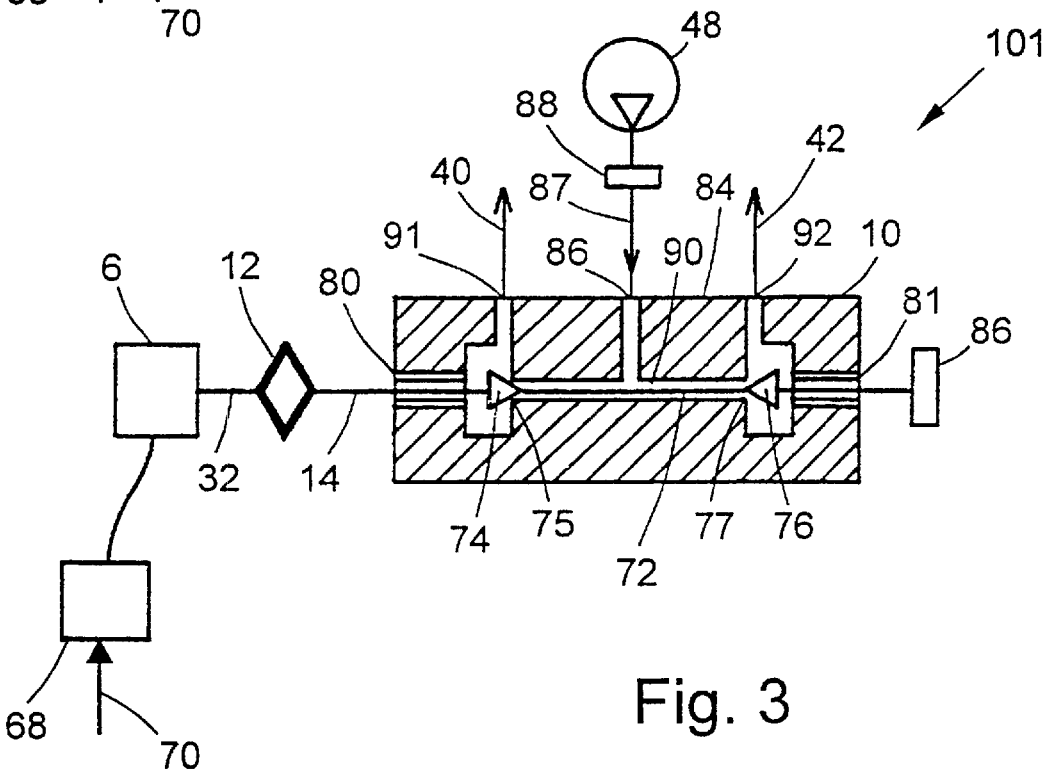

FIG. 3 shows a system 101 fitted with an electric stepping motor 6 irrotationally connected by a bellows connector 12 of the above described kind to the adjustment shaft 14 of a double valve body 72 which it drives. The double valve body 72 contains two throttling valve bodies 74 and 76 rigidly joined to each other in the axial direction which cooperate in mutually opposite directions one each with a throttling valve seat 75 and 77 resp. As either throttling valve body 74 or 76 moves from its valve seat 75 or 76, the other particular throttling valve body 76 or 74 moves closer to its valve seat 77 or 75. The throttle unit 10 of FIG. 3 is schematically shown in an axial section. The throttling valve body 72 can be rotated in threads 80 or 81 of a housing 84 selectively by a manual adjustment element 86 or by the stepping motor 6, said motor being irrotationally joined through the bellows connector 12 and the adjustment shaft 14 to the double valve body 72 which is axially affixed to said shaft and bellows. A central compressed-air intake 86 is connected for flow transmission on one hand through a compressed-air duct 87 fitted with a pressure regulator 88 to the source of compressed air 48 and on the other hand in the housing 84 by means of a duct 90 axially crossed by the double valve body 72 to the two throttling valve seats 75 and 77. The axial duct 90 is separated by the throttling valve bodies 74 and 76 from a first outlet 91 to the conveyance air duct 40 or from a second outlet 92 to the first supplemental air duct 42. In this manner the system 101 of FIG. 3 replaces the two sub-assemblies 1 and their throttles 46 in the conveyance air duct 40 and the supplemental air duct 42 of FIG. 2. This feature offers the advantage of requiring only the double throttle system 101 instead of the two throttles 46 of those two ducts and only one stepping motor 6 and one bellows connector 12 instead of two stepping motors and two bellows connectors. The total rate of conveyance air and of first supplemental air is always kept constant in that the supplemental air flow of the first supplemental air duct 42 is increased or decreased at a predetermined ratio by the system 101 commensurately to the conveyance-air flow of the conveyance air duct 40 being decreased or increased. The embodiment of FIG. 3 offers another advantage, namely only one reference value 70 being required at an electronic control 68 to control the stepping motor 6, said reference value 70 being directly related to the air rate being conveyed by the air conveyance duct 40 and simultaneously also being at a predetermined ratio to the rate of conveyed powder.

What is claimed is:

1. A powder coating system, comprising:

a powder-flow path along which powder is conveyed pneumatically;

at least one compressed-air duct connected to said powder-flow path;

at least one adjustable throttle unit for adjusting a flow in said at least one compressed-air duct;

an electric motor connected to and driving a rotatable adjustment shaft of said at least one throttle unit; and a bellows connector connecting the electric motor and the adjustment shaft of the throttle unit;

wherein a drive shaft of the electric motor the bellow connector and the adjustment shaft of the throttle unit are configured in mutually axial manner; and wherein the bellows connector comprises a bellows of only one pleat.

2. The system as claimed in claim 1, wherein the bend of the pleat is situated at the outside diameter of the bellows.

3. The system as claimed in claim 2, wherein the bellows is made of a material which is resiliently compressible and resiliently stretchable.

4. The system as claimed in claim 1, wherein said bellows consist of said one pleat.

5. The system as claimed in claim 4, wherein said bellows are made of rubber.

6. The system as claimed in claim 4, wherein each of said drive shaft of the electric motor and said adjustment shaft of the throttle unit has a circumferential groove adjacent to said bellows connectors; and said bellows have two ends each received in one of said circumferential grooves.

7. The system as claimed in claim 6, further comprising two O rings each at least partially received in one of said circumferential grooves and clamping the respective end of said bellows against a wall of the respective circumferential groove.

8. The system as claimed in claim 7, further comprising:

a housing accommodating said bellows, said housing having opposite openings through which the drive shaft of the electric motor and the adjustment shaft of the throttle unit extend into an interior of said housing; and an adapter shaft placed inside the housing, the bellows being irrotationally affixed at one end to the drive shaft of the electric motor and at the other end to the adapter shaft which in turn is irrotationally connected to the adjustment shaft of the throttle unit.

9. A powder coating system, comprising:

a powder-flow path along which powder is conveyed pneumatically;

at least two compressed-air ducts connected to said powder-flow path;

for each of said at least two compressed-air ducts, a sub-assembly including an adjustable throttle unit for adjusting a flow in the compressed-air duct;

an electric motor connected to and driving a rotatable adjustment shaft of said throttle unit; and a bellows connector connecting the electric motor and the adjustment shaft of the throttle unit; and an electronic control controlling in a coordinated manner the two electric motors of the two sub-assemblies wherein, in each sub-assembly, a drive shaft of the electric motor, the bellows connector, and the adjustment shaft of the throttle unit are configured in mutually axial manner.

10. A powder coating system, comprising:

a powder-flow path along which powder is conveyed pneumatically;

at least two compressed-air ducts connected to said powder-flow path;

an adjustable throttle unit common for both of said compressed-air ducts for adjusting flows in the compressed-air ducts;

an electric motor connected to and driving a rotatable adjustment shaft of said throttle unit; and a bellows connector connecting the electric motor and the adjustment shaft of the throttle unit;

wherein a drive shaft of the electric motor, the bellows connector, and the adjustment shaft of the throttle unit are configured in mutually axial manner; and the throttle unit comprises a compressed-air intake and two flow throttles coupled to each other and adjusted by the electric motor through the bellows connector in order to distribute compressed air in a predetermined ratio from said compressed-air intake onto two compressed-air ducts.

11. The system as claimed in claim 9, wherein one of the two compressed-air ducts is a conveyance air duct connected to an injector containing said powder-flow path for aspirating powder by generating partial vacuum in said powder-flow path; and the other compressed-air duct is a supplemental-air duct issuing downstream of the conveyance-air duct into the powder-flow path.

* * * * *